US009582972B2

(12) United States Patent
Tavares De Pinho

(10) Patent No.: US 9,582,972 B2
(45) Date of Patent: Feb. 28, 2017

(54) METHOD FOR BANK EQUIPMENT REINFORCEMENT AND FIXATION THROUGH AN ANCHORAGE BASE

(75) Inventor: Nelson Tavares De Pinho, Sao Paulo (BR)

(73) Assignee: TECNOLOGIA BANCARIA S.A., Barueri, SP (BR)

( * ) Notice: Subject to any disclaimer, the term of this patent is extended or adjusted under 35 U.S.C. 154(b) by 416 days.

(21) Appl. No.: 13/010,246

(22) Filed: Jan. 20, 2011

(65) Prior Publication Data

US 2012/0186086 A1 Jul. 26, 2012

(51) Int. Cl.

| | |
|---|---|
| ***E05G 1/024*** | (2006.01) |
| ***G07F 19/00*** | (2006.01) |
| ***E05B 65/00*** | (2006.01) |
| ***E05C 19/00*** | (2006.01) |
| *E05B 15/16* | (2006.01) |

(52) U.S. Cl.

CPC ..... *G07F 19/205* (2013.01); *E05B 65/0082* (2013.01); *E05C 19/001* (2013.01); *E05G 1/024* (2013.01); *E05B 15/1614* (2013.01); *Y10T 29/49632* (2015.01)

(58) Field of Classification Search

CPC .. G07F 19/205; E05C 19/001; E05B 65/0082; E05B 15/1614; Y10T 29/49632; E05G 1/00; E05G 1/04; E05G 1/024; E05G 5/00

USPC ..... 109/24, 80–85, 59 R, 59 T, 49.5, 64, 109/50–52, 78, 87; 52/3, DIG. 14; 902/13, 14, 30; 29/897.34

See application file for complete search history.

(56) References Cited

U.S. PATENT DOCUMENTS

| | | | | | |
|---|---|---|---|---|---|
| 6,655 | A | * | 8/1849 | Hall | 109/83 |
| 642,684 | A | * | 2/1900 | Eyster | 109/68 |
| 1,489,946 | A | * | 4/1924 | Kennedy | 109/83 |
| 1,802,375 | A | * | 4/1931 | Cramer | E05G 1/00 109/50 |
| 1,805,610 | A | * | 5/1931 | Young | 109/29 |
| 1,843,619 | A | * | 2/1932 | Norris | 109/24 |

(Continued)

*Primary Examiner* — Lloyd Gall

(74) *Attorney, Agent, or Firm* — Ladas & Parry LLP

(57) ABSTRACT

METHOD FOR BANK EQUIPMENT REINFORCEMENT AND FIXATION THROUGH AN ANCHORAGE BASE", which is intended for the reinforcement and clamping of ATMS and "Cash Dispensers" type equipment, being characterized by envisioning the installation of jackets (1) in the equipment, being that the jackets (1) are protective plates installed in the safes, being basically composed by a box (2) made of metal plate, having material layers in its internal part having the objective to provide resistance against burglary, being the first layer of material contained in the box (2) forming the jacket (1) a chemical compound (3) providing resistance against the effects of a blow torch while the second layer is preferably produced with concrete (4), providing mechanical strength to the parts; the chemical protection which constitutes the layer (3) is, essentially, a flammable compound, preferably containing bitumen, pitch and sulfur at duly specified layer amounts and thicknesses; in its turn, layer (4), which constitutes the mechanical protection is preferably obtained with reinforced concrete containing cement, aluminum oxide with a number of granulations and steel stretched wires, at the specified amounts.

8 Claims, 14 Drawing Sheets

(56) References Cited

U.S. PATENT DOCUMENTS

| | | | | | |
|---|---|---|---|---|---|
| 4,470,275 | A * | 9/1984 | Fisher | 70/1.5 | |
| 4,489,663 | A * | 12/1984 | Poag | E05G 1/024 | 109/76 |
| 4,754,715 | A * | 7/1988 | Squires | 109/59 T | |
| 4,926,762 | A * | 5/1990 | Paul | 109/51 | |
| 5,305,695 | A * | 4/1994 | Lichter | 109/59 R | |
| 5,341,752 | A * | 8/1994 | Hambleton | E05B 63/20 | 109/59 R |
| 5,377,602 | A * | 1/1995 | Keogh | 109/51 | |
| 5,488,914 | A * | 2/1996 | Ouellette | 109/56 | |
| 5,860,268 | A * | 1/1999 | McWilliams | 52/784.11 | |
| 6,266,930 | B1 * | 7/2001 | Kitabatake | 52/27 | |
| 6,273,007 | B1 * | 8/2001 | Alizade | 109/49.5 | |
| 6,679,087 | B2 * | 1/2004 | Suggs et al. | 70/153 | |
| 2004/0016272 | A1 * | 1/2004 | McCracken | E05B 65/0075 | 70/210 |
| 2010/0170424 | A1 * | 7/2010 | Pinho | G07F 19/205 | 109/50 |
| 2012/0234215 | A1 * | 9/2012 | Tamura | G07D 11/00 | 109/80 |

* cited by examiner

METHOD FOR BANK EQUIPMENT REINFORCEMENT AND FIXATION THROUGH AN ANCHORAGE BASE

FIELD OF THE INVENTION

This description report is related to an Invention Privilege patent which proposes a new method for the reinforcement and clamping of bank equipment, commonly known as ATM, as well as cash dispensing equipment, also known as Cash Dispenser.

This method has, as its general purpose, to provide an increasing on the safety of such equipment, making them substantially more resistant against robbery, depredation attempts and similar actions.

BACKGROUND OF THE INVENTION

As it is generally known, bank institutions, over several years have made available a number of facilities to their customers, such as the ATMs, which are self-service external facilities where a number of operations can be conducted, being cash withdrawal one of the most executed.

Bank institutions also make equipment known as "Cash Dispenser" available, allowing cash withdrawal and other operations and which can be installed in large public circulation places.

In general, both ATM type installations and "Cash Dispensers" have a construction project which shall provide safety against sinister attempts.

It happens that, recently, there have been a significant increase in violence rates, particularly in large urban centers, there's a clear demonstration that the currently used equipments do not provide an appropriate safety level suitable to the techniques used by specialized gangs.

BRIEF SUMMARY OF THE INVENTION

Facing such context, the material described in this Invention Privilege patent, relating to a method for the internal and external structure reinforcement, as well as the clamping and safety means, which are applicable both to ATMs and also to "Cash Dispensers", has been developed in order to make such equipment sufficiently safe.

The method described herein basically shows the main characteristics or approaches to the problem which represents the state of art to be considered in this case, being: a) a set of external armors and an internal armor which can be joined to the equipment structure; b) the improvement of equipment's door locking device; and c) a system intended to anchor the equipment in a base, a clamping set (fixing kit) and an anchorage set (anchorage kit).

BRIEF DESCRIPTION OF THE SEVERAL VIEWS OF THE DRAWINGS

This Invention Privilege patent may be better understood, in all its technical and functional characteristics, through the detailed description that will be conducted based on the drawings listed below, which, for explanation and non-limiting purposes, may be viewed in the following figures, where.

DETAILED DESCRIPTION OF THE INVENTION

As depicted by the figures listed above, the reinforcement method addressed herein comprises a series of devices and mechanical reinforcement elements intended to prevent, as much as possible, the access to the inside of the ATMs and "Cash Dispenser" type equipment, currently available to the public provided by the bank entities operating in our country.

Figure 1:
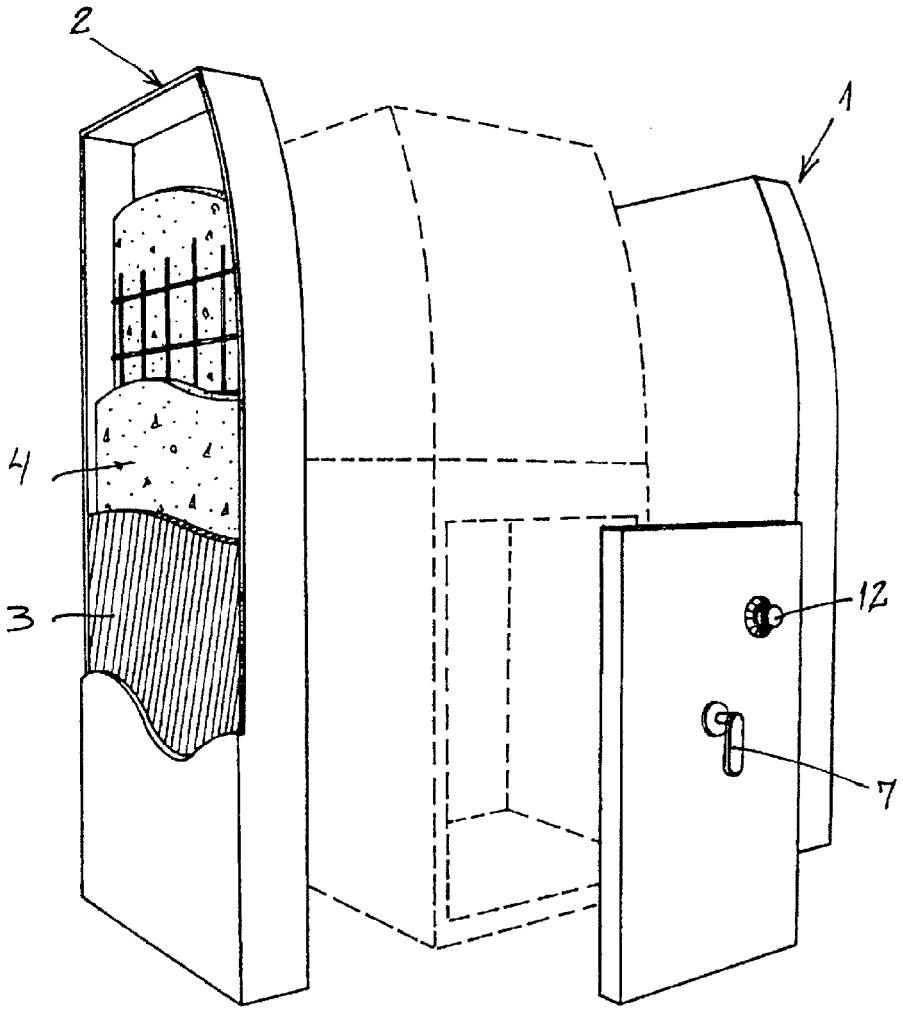
FIG. 1 depicts a general schematic view of a "cash dispenser" type equipment, where armor reinforcement are incorporated, as well as door duly equipped with the locking system herein proposed.
Figure 4:
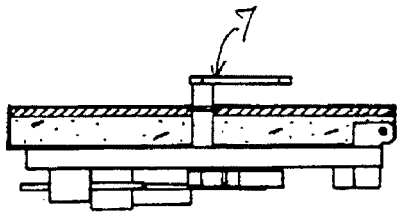
FIG. 4 depicts a view which is also projected from FIG. 2, where the upper region of the said door can be noted.
Figure 3:
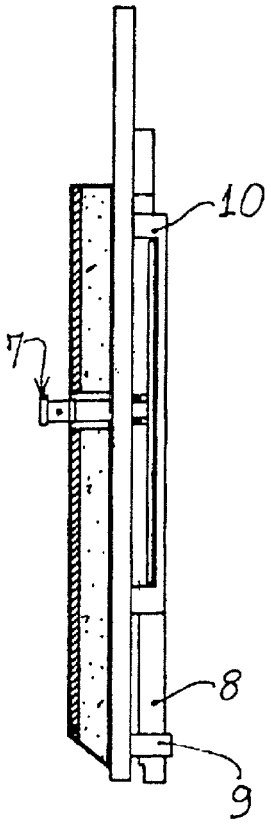
FIG. 3 depicts a view projected from FIG. 2, showing the said door side view.
Figure 2:
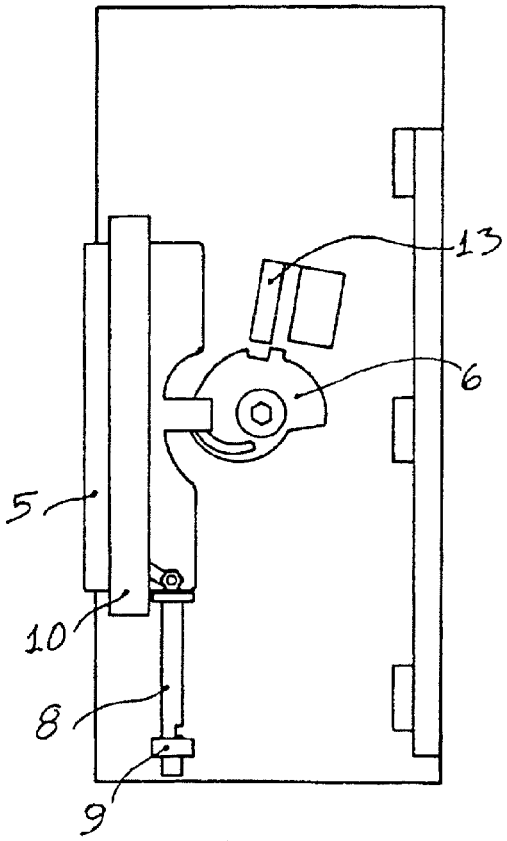
FIG. 2 depicts the equipment's door general and internal view, as described in FIG. 1.
Figure 5:
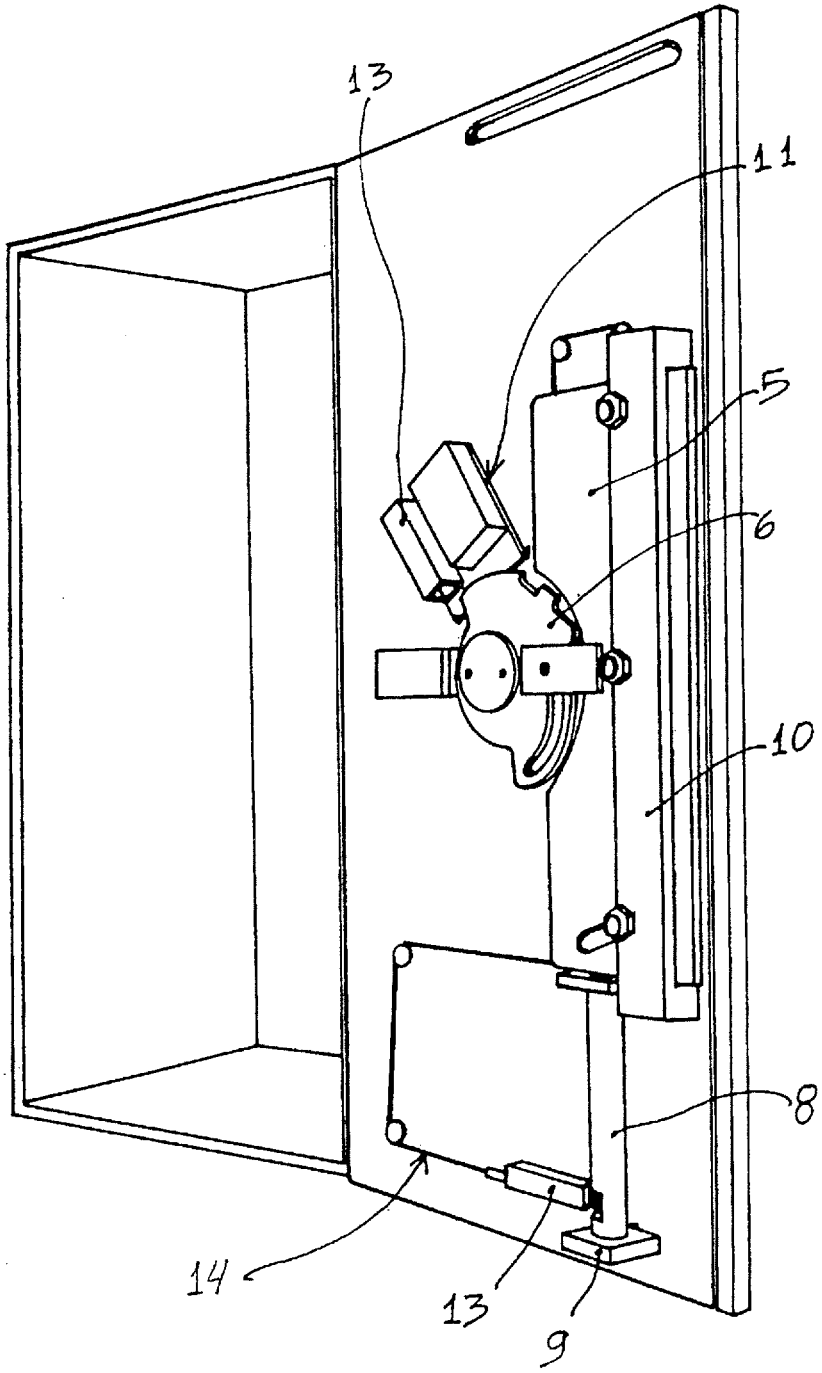
FIG. 5 depicts an schematic detail taken from FIG. 1, where the said door is described in its total opening condition.

One of this methodology main details, proposed by this Invention Privilege patent, consists in the provision of jackets 1 to be assembled and attached to the equipment's side wall, as it can be better understood by observing FIG. 1.

The installation of the jackets 1, mentioned above, as well as the plates thickness and number of equipment's faces which should receive the said jackets 1, are defined according to the risk level and required safety level, considering the equipment model and, further, the installation conditions.

In a more comprehensive way, the jackets 1 are protective plates installed in the safes and are basically composed by a box 2 made of metal plate, internally coated with materials intended to provide protection against burglary.

The first material layer contained in the box 2, defining the jacket 1 structure is a chemical compound 3, which provides protection against the effect of a blow torch and the second layer 4, which is preferably made of concrete, thus providing mechanical strength to the parts.

This patent provides further a chemical protection provision constituted in layer number 3, which is essentially made of a flammable compound, containing, preferably, bitumen, pitch and sulfur, in a duly specified layer amounts and thickness. This compound aims to protect the part against the action of blow torches, condition on which the compounds burst into flame thus producing smoke at amount and nature intended to disturb the vision and even the permanence close to the equipment.

In its turn, layer 4, which constitutes the mechanical protection, as provided in this Invention Privilege patent, is preferably obtained from reinforced concrete, containing cement, aluminum oxide with a number of granulations and steel stretched wire, in an specified amount. The said concrete provides high resistance to abrasion and impact, thus providing protection against the action of equipment such as drilling machines and pointers.

Jackets 1 are installed on the walls and/or the equipment's safe door, always in the face external wall, acting as a protection for the equipment's original metal wall. The clamping of these parts is conducted through screws or nuts (or any other appropriate clamping means), through the internal part of the safe, thus limiting the access the clamping elements.

Another approach as provided for in this Invention Privilege patent consists in improving the equipment's door locking mechanisms, in order to provide increased resistance to burglary attempts; therefore, some items are incorporated or modified so that the desired safety level is achieved.

One of the implemented items is the latch bolt 5, which is a mobile part produced with metal plate, responsible for closing and locking the safe when inside its respective strike box.

The horizontal latch bolt 5 movement is obtained by turning (spin) the cam 6, which is driven, in its turn, by the knob 7.

Figure 6:
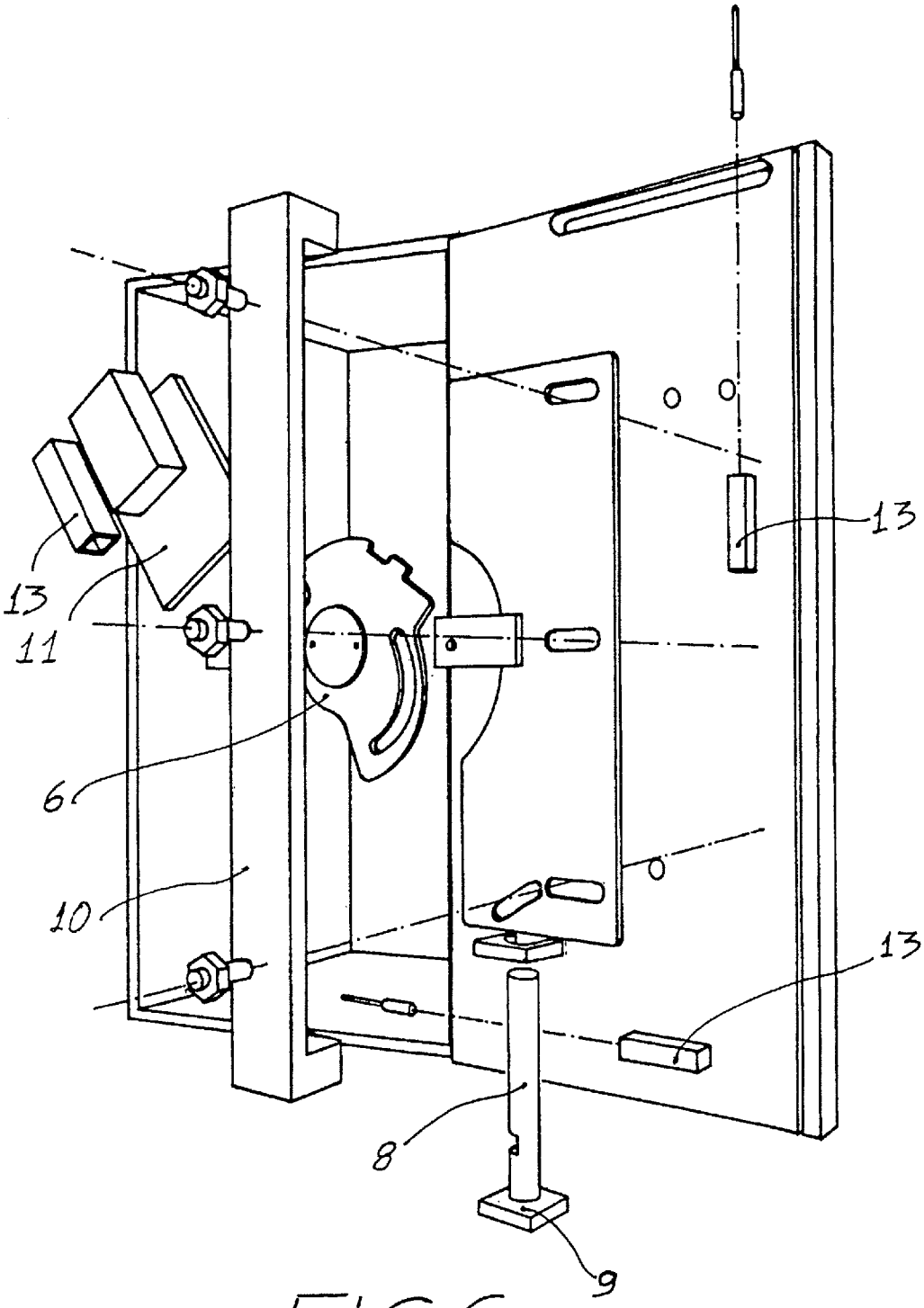
FIG. 6 depicts a similar view to that described in FIG. 5 where, however, the door's mechanical components, which constitute one of this invention privilege patent objects, are shown as an exploded perspective, allowing the visualization of its components separately, but as an ordered relative positioning.

The main latch bolt 5 is connected to the vertical bolt 8, thus moving both of them when activated, being that the said bolt 8, such as it can be better understood by observing FIG. 6, is responsible for locking the safe, when positioned in its respective strike box 9.

Cam 6, in its turn, is the part that prevents the latch bolt 5 from moving, under any condition of applying horizontal stress.

This Invention Privilege patent methodology further envisions the provision of a reinforcement bar 10, which is fixed to the door and is intended to protect the latch bolt in case of burglary Another item proposed by this Invention Privilege patent is the plate 11, which is produced with reinforced steel and placed in the internal side of the door in the lock's 12 region, thus providing increased mechanical protection in that region.

Figure 8:
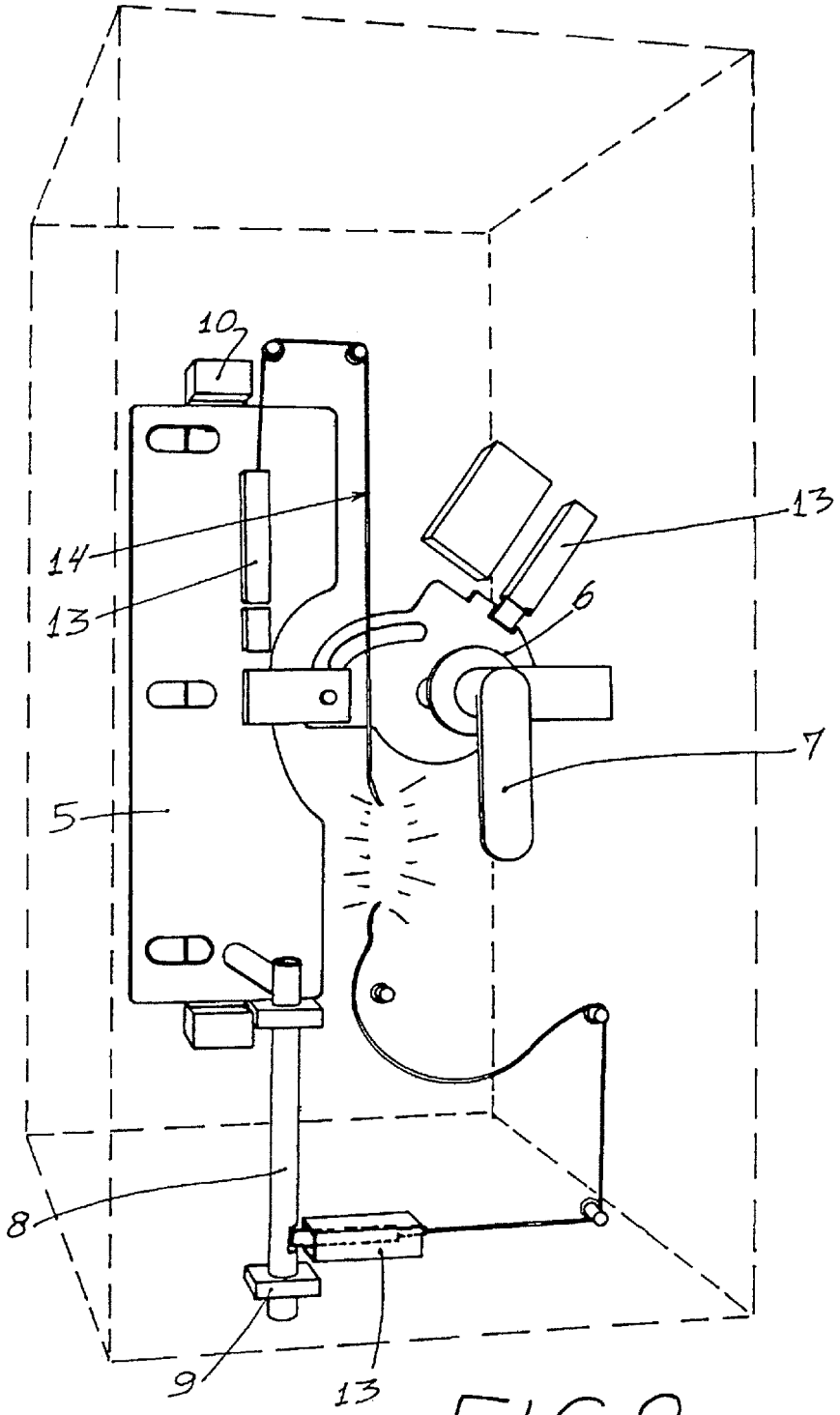
FIG. 8 depicts a situation of the door's safety components activation, as provided in the method described herein.

This Invention Privilege patent further envisions supplementary locking devices 13, which are positioned at strategic points of the door, such as the cam 6, the latch bolt 5 and bolt 8, as it can be better understood by observing FIG. 8.

In said FIG. 8, it is described the fact that two of the supplementary locking devices 13 are joined by a cable 14, which, upon breaking, immediately causes the bolt 8 and the latch bolt 5 to be locked.

The device 13 connected to the cam 6 is activated in case the equipment's safe door lock is attempted to be violated.

Figure 7:
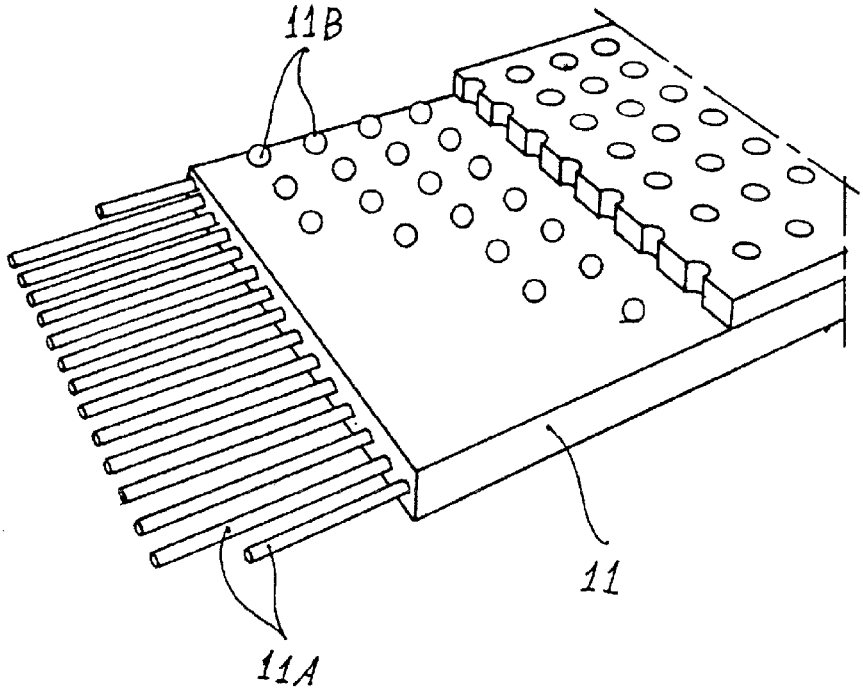
FIG. 7 depicts a detail taken from one of the components incorporated to the improved equipment's door.

FIG. 7 depicts a detail of plate 11 where it can be noted that it is composed by a frame formed by an arrangement of pins 11A and spheres 11B, which are combined in order to form a single body which is the said plate 11.

The method of this Invention Privilege patent also envisions a set called internal jacket, which is assembled in the equipment's safe internal wall and can have a range in thickness and internal components depending on the equipment's model and the available internal area, as it can be better understood from the figures below.

Figure 9:
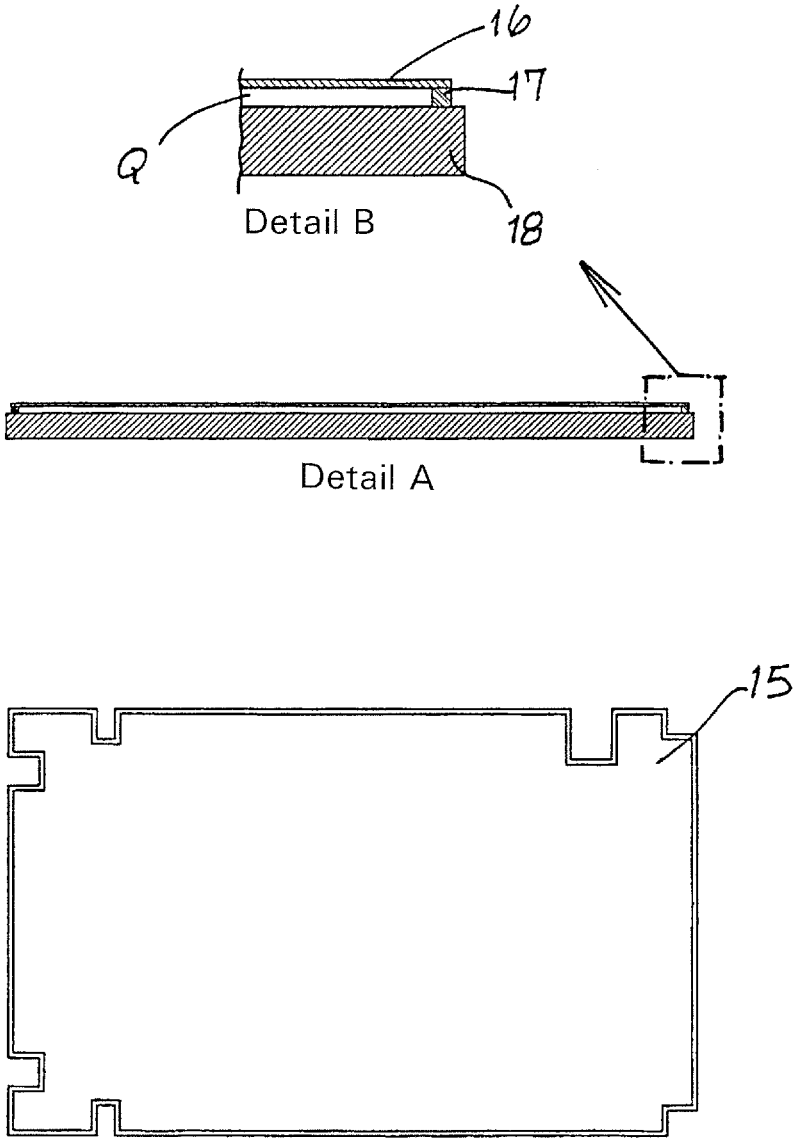
FIG. 9 depicts a general and sectional views of one of the internal armor models, along with the sectioned part (detail A), and an enlarged section (detail B)
Figure 10:
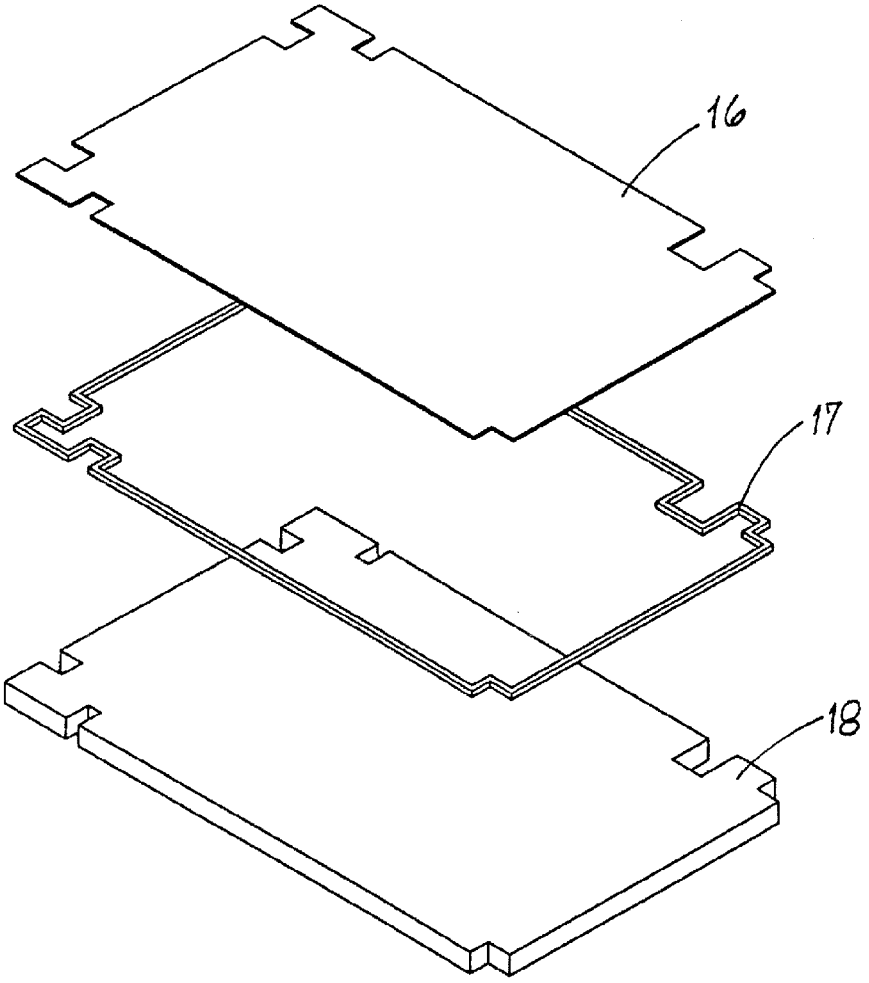
FIG. 10 depicts an exploded view of the above mentioned armor, where its key components can be separately viewed, but at a relative positioning according to a pre-established order.

There is the first model of jacket 15 (FIG. 9), which is preferably composed by a stainless steel plate 16, steel bars 17, which are disposed throughout the stainless steel plate contour, a steel plate 18, positioned under the stainless steel and bar and a chemical protective layer Q between the stainless steel plate and the steel plate, as shown in FIG. 9.

Figure 11:
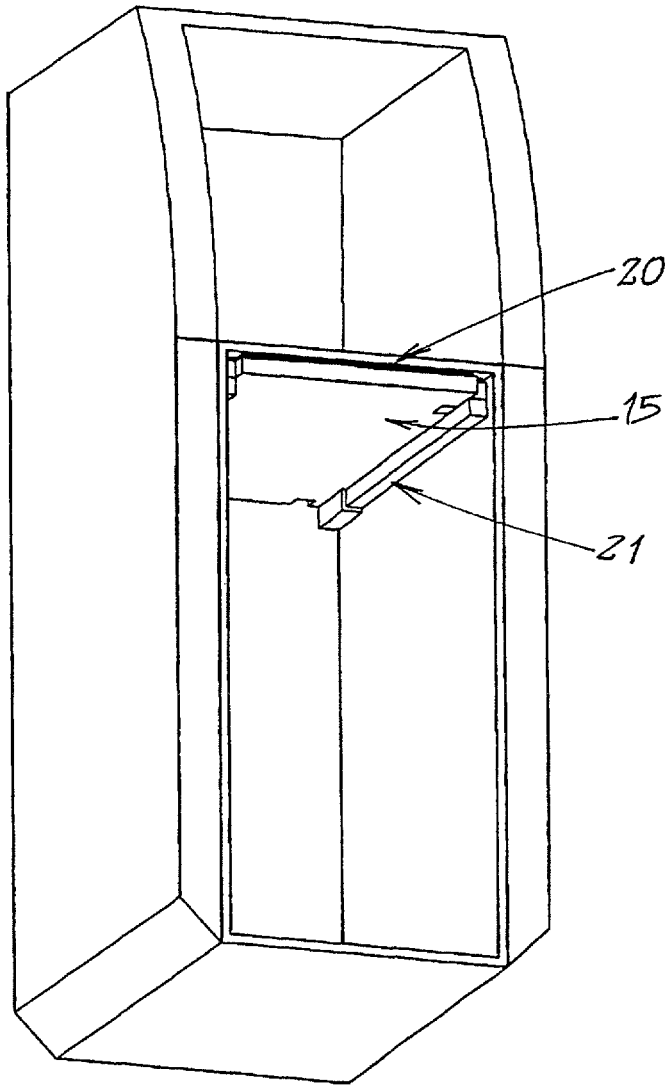
FIG. 11 depicts the above mentioned armor duly applied in an equipment.

The clamping of the jacket 15 to the equipment is conducted in the internal side of the upper safe 20 plate, being welded throughout its contour, along with stainless steel bars 21 placed under the part, as shown in FIG. 11.

Figure 12:
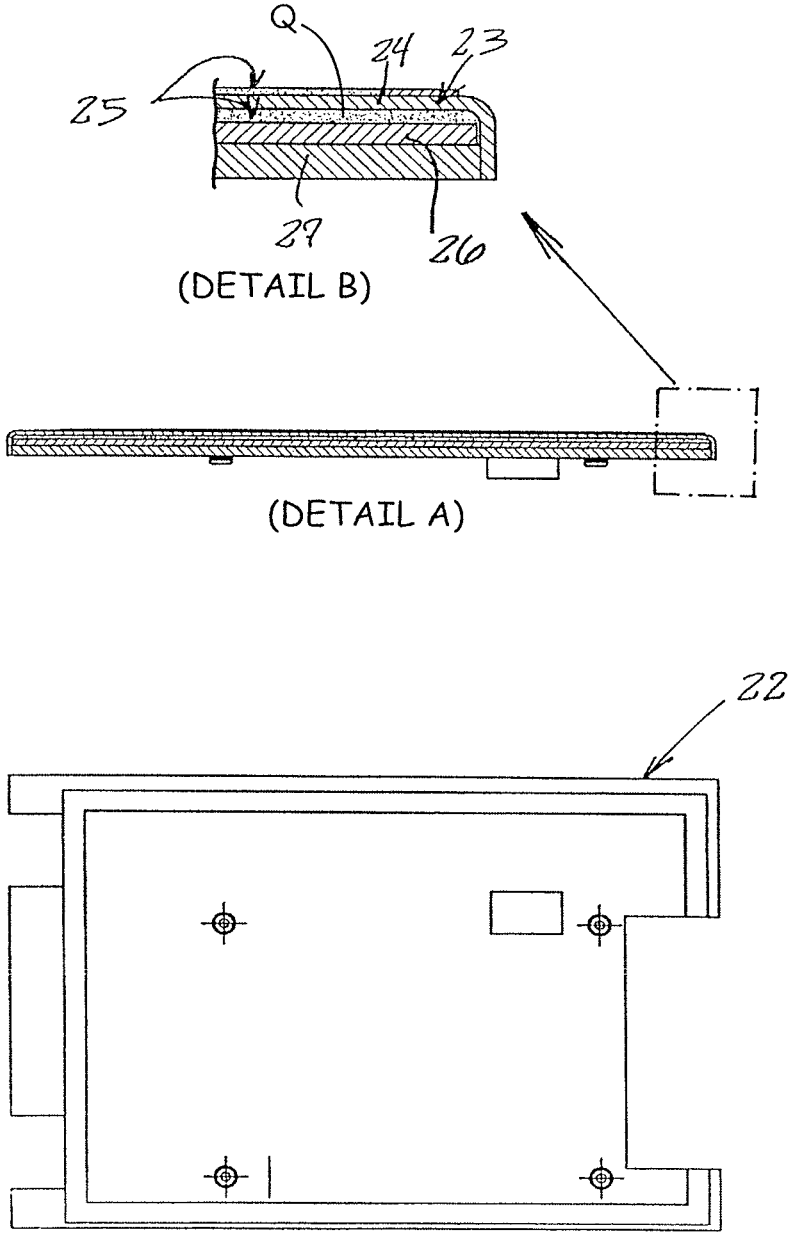
FIG. 12 depicts a general and sectional views of another armor model, along with the sectioned view or the respective part (detail A), as well as an enlarged section of the same (detail B)
Figure 13:
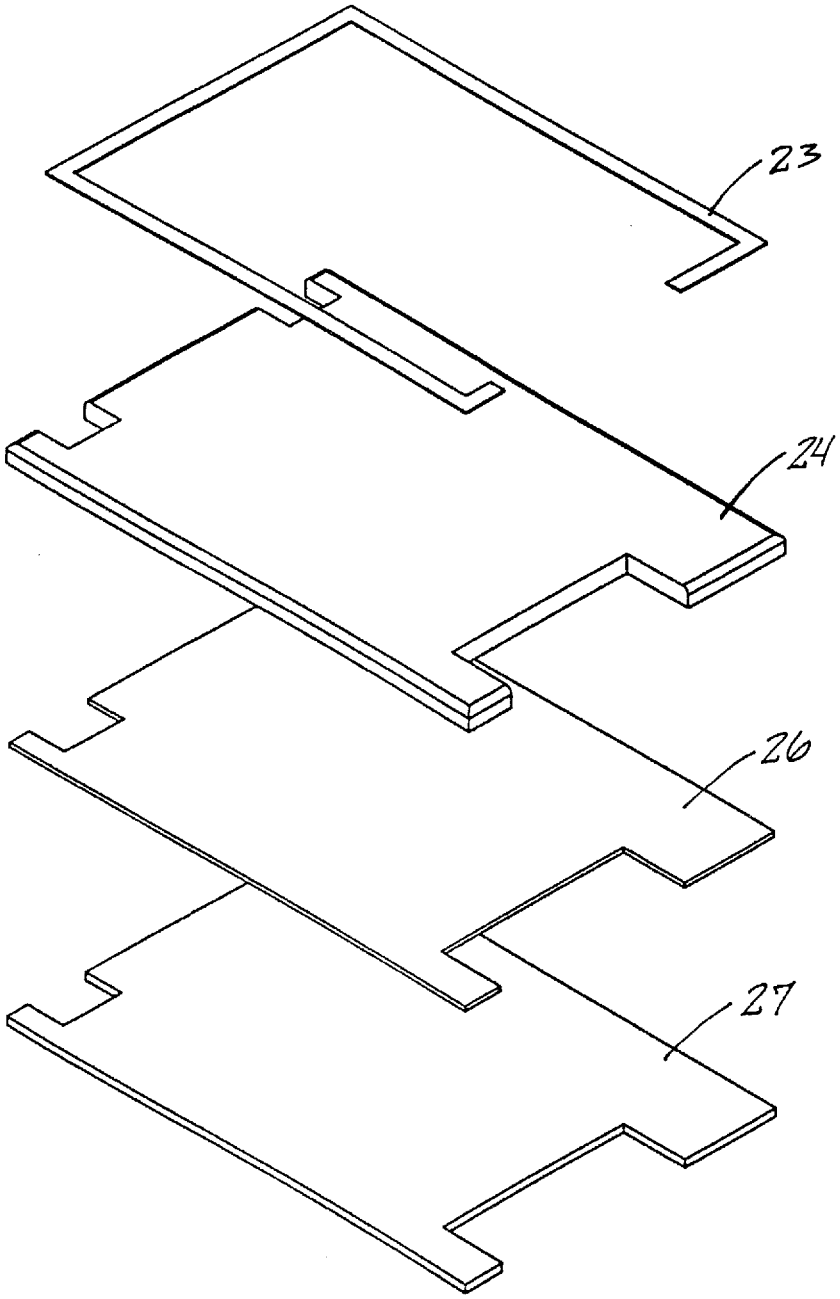
FIG. 13 depicts an exploded view of the above mentioned armor.

In this Invention Privilege patent, there is also the model of jacket 22, which is composed by a steel plate frame 23, a tray-shape steel plate 24, chemical protective layers Q in the upper and internal parts 25, a refractory material plate 26 and a special steel plate 27, as shown in FIG. 12.

Figure 14:
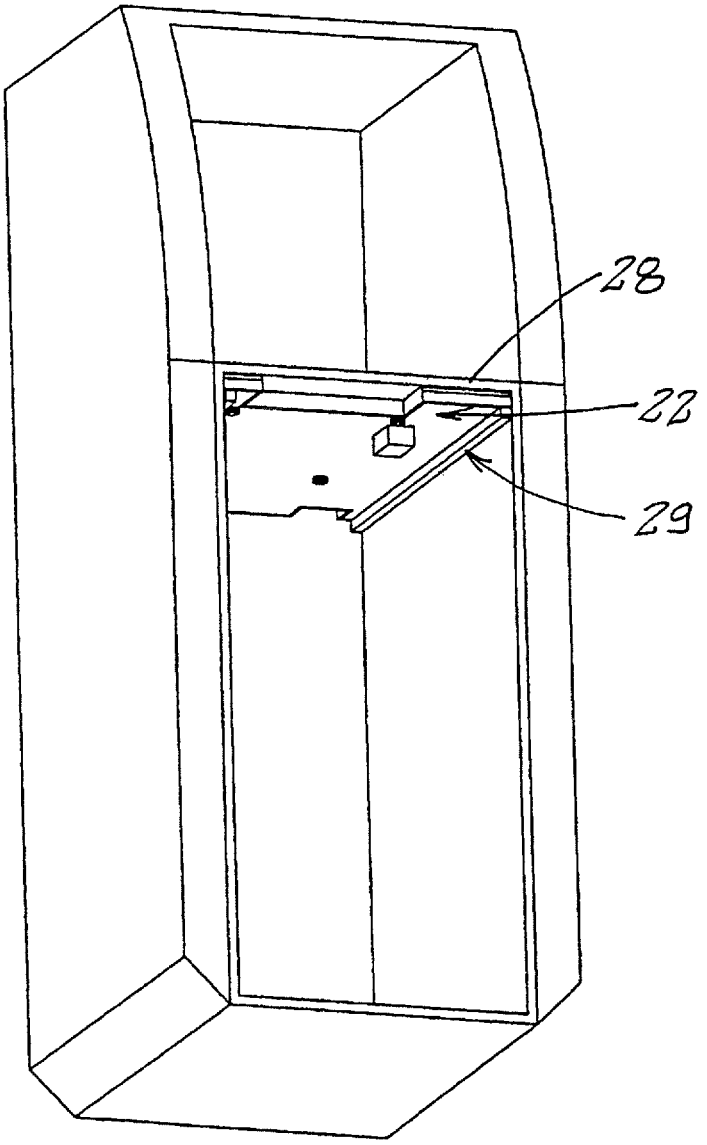
FIG. 14 depicts the above mentioned armor installed in an equipment.
Figure 15:
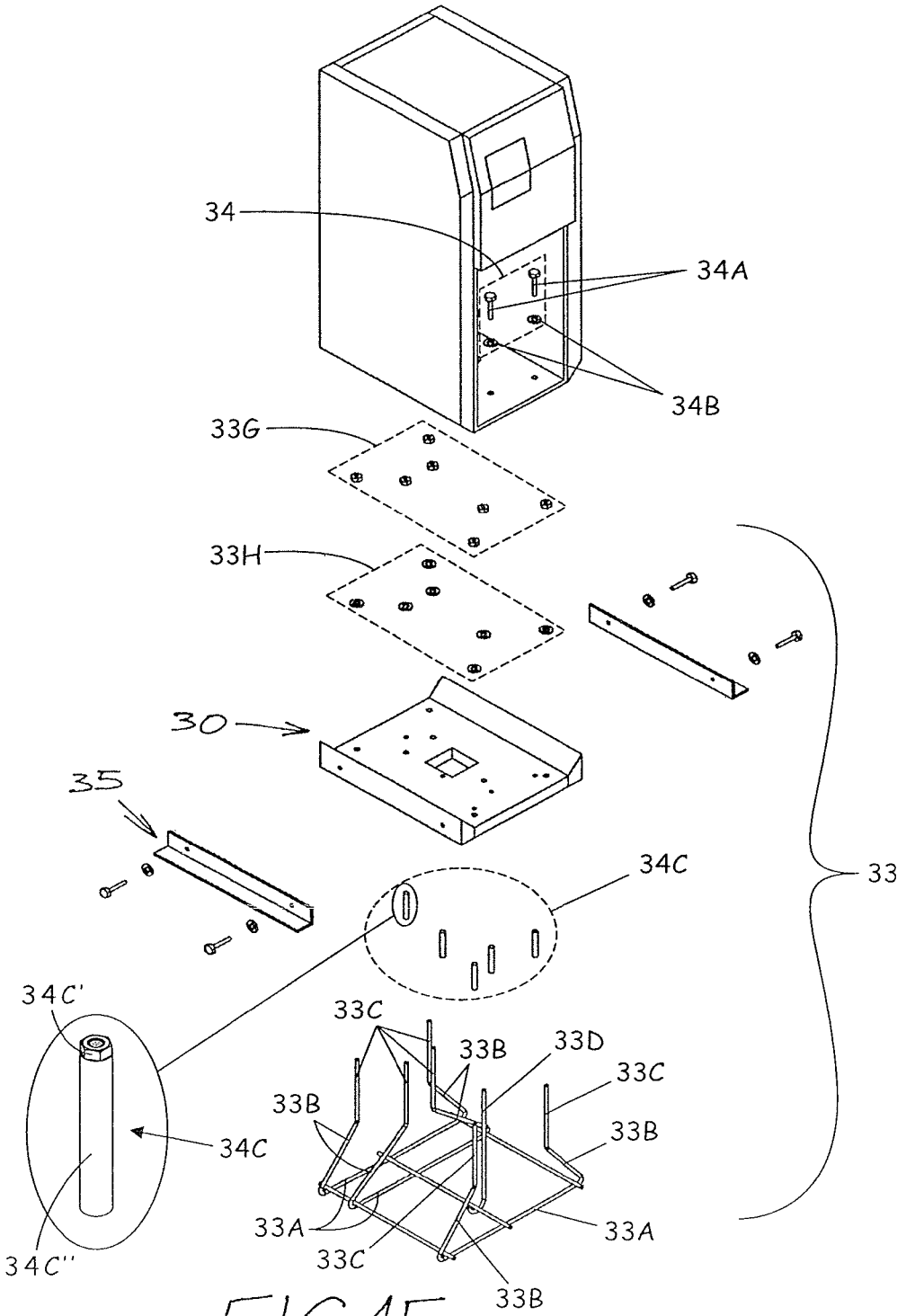
FIG. 15 depicts a general and schematic view of a "Cash Dispenser" type equipment, with the clamping system comprising a base, a clamping set (clamping kit) and an anchorage set (anchorage kit)

The jacket 22 clamping to the equipment is conducted in the internal side of the upper safe 28 plate, being welded throughout its contour, along with steel bars 29 placed under the part, as shown in FIG. 14.

In a more comprehensive way, the clamping system is basically composed by a base 30 made of metal plate with massive square tubes 31, which is internally filled with reinforced concrete 32, aluminum oxide with a number of granulations and steel stretched wire at specified amounts, the said concrete thus provides protection against the effects of actions using equipment such as blow torches, drilling machines and pointers.

A set of trapezoid-shape metal hardware 33, "umbrella handle" 33B type lever and smooth bars 33A which are installed in the bottom of the base through nuts and washers 33C and 33D, being these hardware intended to increase the resistance against mechanical strength, once they are installed along with the concrete 33G and 33H which anchors the base to the floor where the equipment is to be installed.

Finally, this Invention Privilege patent envisions the set (clamping kit) 34 to anchor the equipment on the base, which is composed by a set of screws 34A with a strength class that is higher than the conventional steel, a set of washers 34B and a set of "pipes" 34C intended to protect the screw thread below the base when concrete is placed. The "pipe" 34C is a part composed by a nut 34C' welded to a tube 34C" with the close hole positioned under the base and used to protect the screw thread (34); the base is positioned on the floor using the leveling bracket (35).

One of the main functions of the base is to prevent the equipment from being lifted by using manual, hydraulic or any nature or type tools.

When the equipment has a lateral reinforcement, the base should also have the same reinforcement with plate containing concrete in its internal part; in this case, in order to install the base, a set of brackets called leveling brackets, which are fixed to the side of the base through screws and washers, is used. For equipment without lateral reinforcement, called original equipment, the base will not have the supplementary reinforcement and the leveling brackets will not be used as well. The base can be fixed through chemical anchorage; in this case, the anchorage hardware will not be used.

Figure 17:
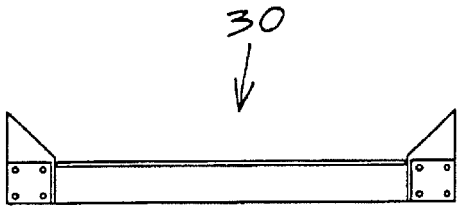
FIG. 17 depicts a view projected from FIG. 16, where the front face of the said base can be viewed.
Figure 18:
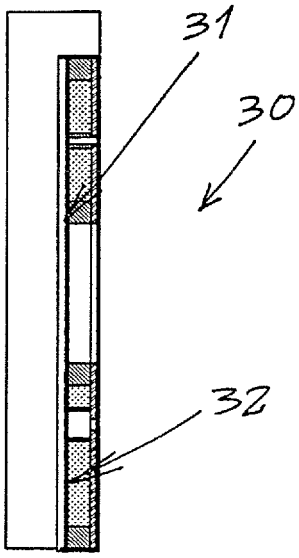
FIG. 18 depicts a view which is also projected from the same FIG. 16, where the base side and sectioned face can be noticed, revealing the presence of massive tubes, anchorage and clamping bushings, as well as reinforced concrete.
Figure 16:
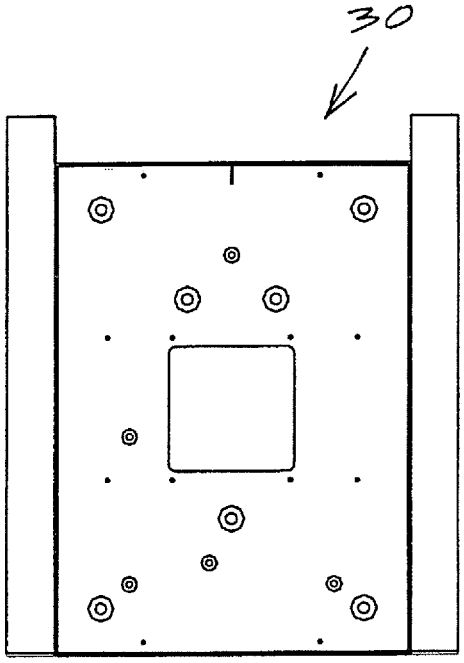
FIG. 16 depicts a general and view of the base described in FIG. 15.

FIGS. 16, 17 and 18 respectively depict general and sectional views and details of the base discussed herein.

I claim:

1. A method for the reinforcement of at least one of an ATM or a cash dispenser, comprising:

installing of jackets in the at least one of an ATM or a cash dispenser, said jackets being protective plates, composed by:

a box made of metal plate, having material layers disposed on an internal part thereof for providing resistance against burglary, wherein the material layers comprise:

a first material layer of a chemical compound providing resistance against the effects of a blow torch;

a second material layer including concrete, which provides mechanical strength;

a third material layer including a flammable compound containing bitumen, pitch and sulfur in specified amounts and thicknesses;

a fourth material layer including a reinforced concrete containing cement, aluminum oxide with a number of granulations and steel stretched wires, at the specified amounts.

2. The method according to claim 1, wherein the jackets are installed on side walls of the at least one of an ATM or a cash dispenser or a safe door of the at least one of an ATM or a cash dispenser, or both the side walls and the safe door of the at least one of an ATM or a cash dispenser, acting as a protection for a metal wall of the at least one of an ATM or a cash dispenser;

clamping of the jackets is conducted through screws or nuts from the inside of the at least one of an ATM or a cash dispenser.

3. The method according to claim 1, wherein the jackets are always installed on the internal and upper walls of a safe of the at least one of an ATM or cash dispenser; the clamping of such jackets is through welding throughout a contour of the jackets with the reinforcement help of steel bars.

4. The method according to claim 1, further comprising:

improvement of a door locking mechanism for the at least one of an ATM or a cash dispenser by adopting a main latch bolt comprising a mobile part produced with a metal plate; and which is responsible for closing and locking a safe of the at least one of an ATM or cash dispenser when positioned inside its respective strike box;

the horizontal movement of the main latch bolt is obtained by turning a cam, which is activated by a knob;

the main latch bolt is connected to a vertical bolt, movement of both the main latch bolt and the vertical bolt are affected by the turning of the cam; the vertical bolt is responsible for locking the safe, when positioned into its respective strike box; the cam is, in its turn, the part which prevents the main latch bolt from moving under application of horizontal stress.

5. The method according to claim 1, wherein the at least one of an ATM or cash dispenser comprises a reinforcment bar, which is fixed to a door and protects a latch bolt in case of burglary.

6. The method according to claim 1, wherein the at least one of an ATM or cash dispenser comprises a plate, including reinforced steel, placed inside a door in the region of a lock, thus providing increased mechanical protection to this region; the plate is composed by a structure formed by an arrangement of pins.

7. A method for the reinforcement of at least one of an ATM or a cash dispenser, comprising the installation of a jacket inside the at least one of an ATM or a cash dispenser, the jacket is composed by a plate made of stainless steel, steel bars, which are disposed throughout a stainless steel plate contour, a steel plate, placed below the stainless steel and bar set providing mechanical strength to the plate and a chemical protective layer defined by a flammable compound containing, bitumen, pitch and sulfur at the specified amount and thickness, disposed between the stainless steel plate and the steel plate.

8. A method for the reinforcement of at least one of an ATM or a cash dispenser, comprising:

providing an installation in the at least one of an ATM or a cash dispenser using a clamping system through a metal base, the metal base comprising a metal plate with massive tubes disposed along at least one side of the metal plate, the massive tubes containing therein a material intended to provide resistance against the effect of blow torches, drilling machines and pointers, wherein such material constitutes the mechanical protection obtained in reinforced concrete, which comprises cement, aluminum oxide with a number of granulations and steel stretched wires, at specified amounts;

the metal base is fixed to a floor through a set of trapezoid-shape hardware, handle type lever and smooth bars called anchorage and the at least one of an ATM or a cash dispenser is fixed to the metal base through a set of screws, washers and a nut welded to a tube with a closed hole positioned under the metal base and used to protect threads of the screws; and positioning the metal base on the floor using a leveling bracket.

* * * * *